US006521035B1

(12) United States Patent
Shiraishi

(10) Patent No.: US 6,521,035 B1
(45) Date of Patent: Feb. 18, 2003

(54) INK FOLLOW UP COMPOSITION FOR WATER-BASE BALL PEN

(75) Inventor: Katsuhiko Shiraishi, Yokohama (JP)

(73) Assignee: Mitsubishi Pencil Kabushikikaisha, Tokyo (JP)

( * ) Notice: Subject to any disclaimer, the term of this patent is extended or adjusted under 35 U.S.C. 154(b) by 0 days.

(21) Appl. No.: 09/786,121

(22) PCT Filed: Sep. 21, 1999

(86) PCT No.: PCT/JP99/05150

§ 371 (c)(1),
(2), (4) Date: Mar. 1, 2001

(87) PCT Pub. No.: WO00/16992

PCT Pub. Date: Mar. 30, 2000

(30) Foreign Application Priority Data

Sep. 24, 1998 (JP) ..... 10-269197

(51) Int. Cl.[7] ..... B43K 7/08

(52) U.S. Cl. ..... 106/287.14; 106/287.1; 106/287.11; 516/100; 516/101; 401/142

(58) Field of Search ..... 106/287.1, 287.11, 106/287.14; 516/100, 101; 401/142

(56) References Cited

U.S. PATENT DOCUMENTS 6,376,560 B1 * 4/2002 Ogura et al. ..... 137/205

6,454,481 B1 * 9/2002 Izumi ..... 401/141

FOREIGN PATENT DOCUMENTS

| | | |
|---|---|---|
| GB | 2 281 257 A | 3/1995 |
| JP | 8-300874 A | 11/1996 |
| JP | 9-076687 A | 3/1997 |
| JP | 2791864 | 6/1998 |

OTHER PUBLICATIONS

Patent Abstracts of Japan, Publication No. 08–183286, Publication Date: Jul. 16, 1996; Inventors: Sonoda Yasuo et al.; Ink Reverse Flow–preventing Element for Water–based Ink.

* cited by examiner

*Primary Examiner*—David Brunsman
(74) *Attorney, Agent, or Firm*—Kubovcik & Kubovcik

(57) ABSTRACT

The present invention relates to an ink follower for a water-base ballpoint pen, which has strong pseudoplasticity by causing $HO(C_2H_4O)_m.(C_3H_6O)_nH$ to interfere with hydrophobic silica which is likely to disperse stably in silicone oil. Moreover, this ink follower for a water-base ballpoint pen keeps its stable performance of little long-term change of its viscosity. In order to improve long-term stability of the water-base ballpoint pen using this ink follower, the ink follower is made to comprise silicone oil, hydrophobic silica and $HO(C_2H_4O)_m.(C_3H_6O)_nH$ (in which each of m and n shows 0 or a positive integer, provided that m+n is not equal to 0).

3 Claims, 1 Drawing Sheet

INK FOLLOW UP COMPOSITION FOR WATER-BASE BALL PEN

This application is a 371 of PCT/JP99/05150 filed Sep. 21, 1999.

TECHNICAL FIELD

The present invention relates to a water-base ballpoint pen which has an ink reservoir directly filled with ink. More particularly, the present invention relates to an ink follower to be used at the tail end of the ink in such a water-base ballpoint pen.

BACKGROUND ART

The ink for a water-base ballpoint pen has a viscosity of as low as 50 mPa·sec to 3 Pa.sec, while the ink for an oil-base ballpoint pen of a similar structure to a water-base pen has a viscosity of 3 to 20 Pa.sec. Consequently, the ink filled in a water-base ballpoint pen may leak out when the pen is left upward or sideways.

Moreover, even a small impact made on the pen may cause its ink to scatter and to stain the hand or the clothes. Therefore, the water-base ballpoint pen is equipped with an ink follower for preventing such accidents.

Various types of ink followers for water-base ballpoint pens which have an ink reservoir directly filled with ink, which are consisted of gel-like material or the mixture of gel-like material and solid material, are disclosed in many prior applications such as JP48-40510A, JP57-153070A, JP57-200472A, JP58-1772A, JP61-57673A, JP61-145269A, JP61-151289A, JP61-200187A, JP61-268786A, JP62-50379A, JP62-148581A, JP62-199492A, JP63-6077A, JP02-248487A, JP04-202281A, JP05-270192A, JP05-270193A, JP06-200235A, JP06-220418A, JP06-247094A, JP06-264048A, JP06-328890A, JP06-336584A, JP07-61187A, JP07-173426A, JP07-214974A, JP07-214975A, JP07-242093A, JP07-266780A, JP08-2171A, JP08-11481A, JP08-58282A, JP08-72465A, JP08-90982A, JP08-108679A, JP08-142570A, JP08-183286A, JP08-300873A, JP08-300874A, JP09-11683A, JP09-76687A and so on.

The purposes of these prior arts are to make the ink follower follow the ink smoothly, to make the pen endure the impact when dropped, to prevent the ink from back flow, to give the pen a good appearance, and so on.

Of the above prior arts, the ink followers disclosed in JP08-300874A and JP09-76687A are characterized in that hydrophilic silica serving as a thickener is added to silicone oil as a base oil. The ink follower disclosed in JP09-76687A additionally contains poly (oxyethylene-oxypropylene) polyol. In the other prior arts, disclosed are many types of ink followers in which silicone oil is used as a base oil or which contain hydrophobic silica as a thickener.

However, when hydrophobic silica is used to thicken the silicone oil, there has been some problems that it is difficult to gain a desired viscosity, especially that in the low shear rate range, and that it is difficult to handle such an ink follower for a long-term increase of its viscosity.

As mentioned above, when the ink follower shows the long-term increase of its viscosity, it interferes with smooth ink flow. Consequently, the shortage of the ink flow causes a phenomenon called "scratchy writing," which means that the drawn line with the pen is scratchy and the pen cannot write well.

On the other hand, a use of a small amount of hydrophilic silica ensures the desired viscosity, but has a defect of a long-term decrease of the viscosity.

As mentioned above, the long-term decrease of the viscosity of the ink follower causes the ink follower to flow out through the tail end of the ballpoint pen when the ballpoint pen is left sideways or upward. Thus the ink follower loses its function of preventing ink leakage and evaporation.

The difference in the technical idea between the prior art and the present invention is explained in view of the role of $HO(C_2H_4O)_m.(C_3H_6O)_nH$ (in which each of m and n shows 0 or a positive integer, provided that m+n is not equal to 0) including poly (oxyethylene-oxypropylene) polyol used in the present invention and that of poly (oxyethylene-oxypropylene) polyol used in JP09-76687A. In regard to the comparison described below, explanation is made with poly (oxyethylene-oxypropylene) polyol as an example.

In JP09-76687A, the use of hydrophilic silica is essential. This is because poly (oxyethylene-oxypropylene) polyol is intended to adsorb the hydrophilic groups such as a hydroxyl group on the surface of the hydrophilic silica and to disperse stably in silicone oil.

On the other hand, the particulate silica as an essential factor in the present invention has methyl groups on its surface in place of the hydrophilic groups. Namely, as seen microscopically, methyl groups are bonded on the surface of the Si—O chain as well as dimethylsilicone oil.

Therefore, the hydrophobic particulate silica is likely to exist separately in silicone oil. Since the particulate silica is well dispersed, a network structure, which is a thickening principle of a silica thickener, is unlikely to develop. As a result, the structural viscosity is small, and the viscosity in a low shear rate range is unlikely to be obtained.

When poly (oxyethylene-oxypropylene) polyol is considered as a dispersant as in JP09-76687A, it is believed that poly (oxyethylene-oxypropylene) polyol selectively adsorbs to, and covers over the hydrophilic silica.

However, it is not believed that poly (oxyethylene-oxypropylene) polyol covers over the surface of the hydrophobic silica since the surface of hydrophobic silica is almost occupied with methyl groups, which serve as steric hindrances.

Probably, it is presumed that poly (oxyethylene-oxypropylene) polyol adsorbs to the hydrophilic residues of the hydrophobic silica and that the viscosity increases by its function of bonding between the silica particles. This will be rather opposite to the idea of the present invention that "the dispersant disperses the particles more finely and more stably."

In the present invention, poly (oxyethylene-oxypropylene) polyol serves as a weak crosslinking agent between hydrophobic silica particles. Similar discussion can also be made for as methylphenylsilicone oil, alkyl-modified silicone oil etc., which have no hydrophilic groups.

This means the critical difference in the technical idea between the invention in JP09-76687A and the present invention.

Namely, the use of poly (oxyethylene-oxypropylene) polyol in JP09-76687A has a purpose of "stabilization of dispersion". On the other hand, poly (oxyethylene-oxypropylene) polyol in the present invention is used to obtain a viscosity of the ink follower by the interference of the hydrophilic residue of hydrophobic silica with the stable suspension system that comprises hydrophobic silica and silicone oil.

The invention disclosed in JP09-76687A is an excellent technique of dispersing hydrophilic silica, though essentially immicible, stably in silicone oil. However, since there occurs long-term reactions between the adsorbed polyol chains and hydrophilic groups covering over the surface of the silica, the stabilization of dispersion proceeds further and the viscosity is lost. Moreover, it has disadvantages such as a striking acid smell due to an oxidation of decomposed polyol chains.

In the present invention, on the other hand, chemical reaction is unlikely to occur. Moreover, since the long-term unstable factor of hydrophilic residues, which are slightly remained on the surface of hydrophobic silica, is intentionally utilized, the particulate silica is prevented from forming a network structure to give a long-term strong structural viscosity, thus providing an effect of preventing the long-term increase of the viscosity of the ink follower.

DISCLOSURE OF THE INVENTION

The present invention is to provide an ink follower composition for water-base ballpoint pens, which is prevented from long-term change of viscosity and always keeps its initial performance irrespective of the ingredients of the ink.

Moreover, the invention is to provide an ink follower having the ability to shield ink from outer air to prevent the ink from evaporating (anti-evaporation), the ability to prevent ink from leaking out through the tail end of the ink reservoir after writing with the pen upward (anti-leakage), the ability to minimize its adhering amount onto the inner wall of the ink reservoir and to retain its function to follow ink to the last (following ability).

We, the present inventors, have endeavored to study the objects mentioned as above, and, as a result, have found that, when using hydrophobic silica in silicone oil, $HO(C_2H_4O)_m.(C_3H_6O)_nH$ (in which each of m and n shows 0 or a positive integer, provided that m+n is not equal to 0) has a specifically thickening effect and gives the ink follower long-term stable pseudoplasticity. On the basis of these findings, we have completed the present invention.

Namely, the present invention utilizes the specific thickening effect in a system of silicone oil and hydrophobic silica. Accordingly, the non-volatile or hardly-volatile solvent to be the base oil for use in the present invention must consist essentially of silicone oil.

Further, mineral oils, animal or vegetable oils, esters, high-boiling-point hydrocarbons, higher fatty acids, higher alcohols, low-molecular polyolefins and the like may be added for the present invention. However, since the essential base oil is silicone oil, the additional amount of above-mentioned oils is dependent on their compatibility and miscibility with silicone oil. Concretely, the list of silicone oil for use in the present invention includes dimethylsilicone oil, methylphenylsilicone oil, and alkyl-modified silicone oil. Each of them may be used individually, otherwise some of them may be mixed for use.

Amino-modified silicone oil, polyether-modified silicone oil, fatty acid-modified silicone oil and the like are unfavorable for the essential base oil since poly (oxyethylene-oxypropylene) polyol has little effect for assistance of thickening in these oils and since the dispersion stability of hydrophobic silica in these oils is relatively lower than that in dimethylsilicone oil, methylphenylsilicone oil or alkyl-modified silicone oil. However, these oils are sometimes added supplementarily.

Surface-methylated particulate silica is used as the thickener in the present invention. However, hydrophobic inorganic particulate thickener is presumed to have a similar effect.

Moreover, Specific examples of $HO(C_2H_4O)_m.(C_3H_6O)_nH$ (in which each of m and n shows 0 or a positive integer, provided that m+n is not equal to 0) are ethylene glycol, polyethylene glycol, poly (oxyethylene-oxypropylene) polyol, polypropylene glycol, propylene glycol, etc. Needless to say, any other compounds can be used as long as they satisfies the formula. In the compounds that satisfies the formula, $(C_2H_4O)$ and $(C_3H_6O)$ may have any desired configuration including, for example, alternate blocks and random blocks.

The ink follower composition in the present invention usually contains a singular base oil or the mixture of this oil and supplementary non-volatile or hardly-volatile solvent. To the base oil, hydrophobic silica is added and kneaded homogeneously in a disperser such as a triple roll mill, a kneader, a ball mill, a bead mill, a basket mill or the like.

It is preferable that $HO(C_2H_4O)_m.(C_3H_6O)_nH$ (in which each of m and n shows 0 or a positive integer, provided that m+n is not equal to 0) is either mixed homogeneously when the base oil is mixed, or added after the hydrophobic silica disperses homogeneously.

This is because there sometimes occurs uneven viscosity when the $HO(C_2H_4O)_m.(C_3H_6O)_nH$ (in which each of m and n shows 0 or a positive integer, provided that m+n is not equal to 0) is first adsorbed to the powdery hydrophobic silica.

So far as the ingredients being mixed could receive sufficient shearing force to form the intended homogeneous mixture, for example, in the case of using a disperser, such as a triple roll mill, with a strong shearing force, the order of adding the ingredients is not specifically defined.

As mentioned above, the ink follower for water-base ballpoint pens in the present invention can well retain its initial properties even when its initial viscosity is suitably prepared and have excellent long-term stability.

BEST MODES FOR CARRYING OUT THE INVENTION

Figure 1:
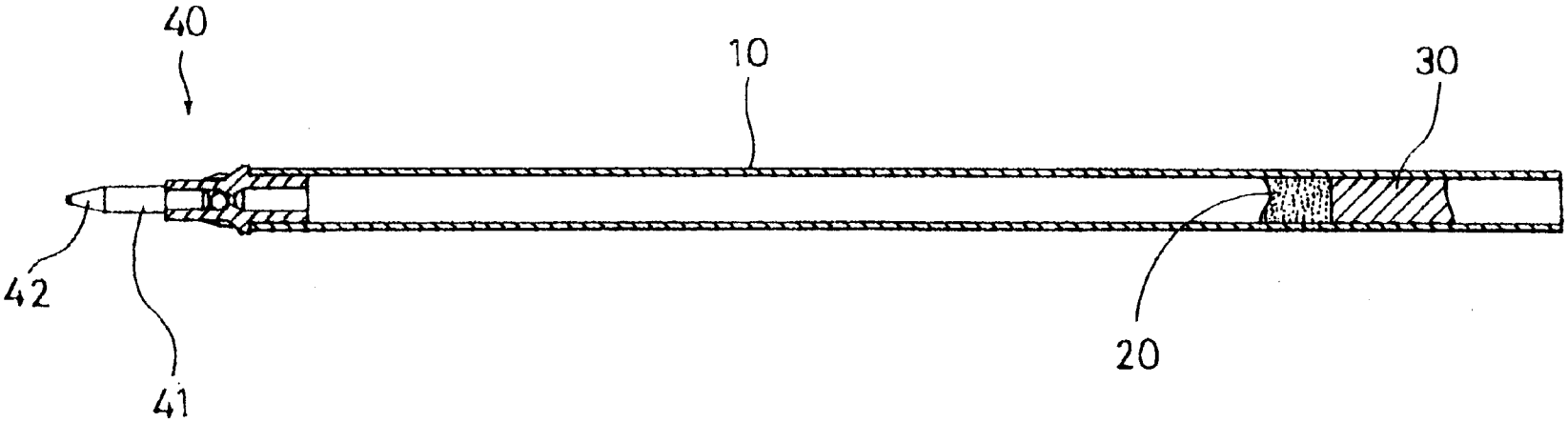
FIG. 1 is a cross-sectional view of an embodiment of a refill holder for a water-base ballpoint pen, in which the ink follower in the present invention is used.

The present invention is explained below with reference to its embodiments.

As shown in FIG. 1, the invention relates to an ink follower 30 for a water-base ballpoint pen with an ink reservoir 10 filled with an ink 20 inside and an ink follower 30 at the tail end of the ink 20. In addition, 40 shows a joint between the pen tip 41 and the ink reservoir 10 and 42 shows a ball.

In order to evaluate the embodiments and controls as described below, an ink for water-base ballpoint pens was prepared as follows:

Printex 25 (carbon black; Degussa) (6 parts by weight);

Johncryl 61J (styrene-acrylic acid copolymer emulsion, 31% ammonia-neutralized aqueous solution; Johnson Co., Ltd.) (10 parts by weight);

Acronal YJ-1120D (styrene-methacrylic acid copolymer, 50% emulsion; Mitsubishi Chemical BASF Co., Ltd.) (10 parts by weight);

glycerin (10 parts by weight);

potassium ricinoleate (0.5 parts by weight);

triethanolamine (1 part by weight);

1,2-benzisothiazolin-3-one (0.2 parts by weight);

benzotriazole (0.2 parts by weight);

SILWET L7001 (silicone-type surfactant; Nippon Unicar Co., Ltd.) (0.2 parts by weight) and water (11.5 parts by weight).

The above ingredients were kneaded in a bead mill, and coarse particles of carbon black were removed from the mixture. Then, propylene glycol (20 parts by weight), Carboball 940 (crosslinked-polyacrylic acid; BFGoodrich) (0.4 parts by weight) and water (30 parts by weight)

were added to the mixture. Thus the ink for water-based ballpoint pens with a viscosity of 450 mPa·sec at 40 $sec^{-1}$ was obtained.

Moreover, the ink followers were prepared as follows.

Embodiment 1

KF-96A-1000 (dimethylpolysiloxane; Shin-Etsu Chemical Co., Ltd.) (95 parts by weight), Aerosil R972 (hydrophobic particulate silica; Nippon Aerosil Co., Ltd.) (4 parts by weight) and Unilube 75DE-5000 (poly (oxyethylene-oxypropylene) polyol; NOF Corporation) (1 part by weight)

were kneaded in a triple roll mill to prepare an ink follower.

Embodiment 2

L45 (5000) (dimethylpolysiloxane; Nippon Unicar Co., Ltd.) (96.5 parts by weight), Aerosil R974 (hydrophobic particulate silica; Nippon Aerosil Co., Ltd.) (3 parts by weight) and polyethylene glycol 600 (Wako Pure Chemical Industries, Ltd.) (0.5 parts by weight)

were kneaded in a triple roll mill to prepare an ink follower.

Embodiment 3

TSF451-3000 (dimethylpolysiloxane; GE Toshiba Silicones Co., Ltd.) (96 parts by weight), Aerosil RY200 (hydrophobic particulate silica; Nippon Aerosil Co., Ltd.) (3 parts by weight) and Unilube 75DE-2620 (poly (oxyethylene-oxypropylene) polyol; NOF corporation) (1 part by weight)

were kneaded in a triple roll mill to prepare an ink follower.

Embodiment 4

KF-50-3000 (methylphenylpolysiloxane; Shin-Etsu Chemical Co., Ltd.) (95 parts by weight), Aerosil R974 (4 parts by weight) and polypropylene glycol 300 (Wako Pure Chemical Industries, Ltd.) (1 part by weight)

were kneaded in a triple roll mill to prepare an ink follower.

Embodiment 5

TSF4420 (alkyl-modified silicone oil; GE Toshiba Silicones Co., Ltd.) (96.5 parts by weight), Aerosil R974 (3 parts by weight) and ethylene glycol (Wako Pure Chemical Industries, Ltd.) (0.5 parts by weight)

were kneaded in a planetary mixer to prepare an ink follower.

Control 1

KF-96A-1000 (90 parts by weight) and

Aerosil R972 (10 parts by weight)

were kneaded in a triple roll mill to prepare an ink follower.

Control 2

KF-96A-1000 (95 parts by weight),

Aerosil R972 (4 parts by weight) and

KBM-600 (silane coupling agent; Shin-Etsu Chemical Co., Ltd.) (1 part by weight)

were kneaded in a triple roll mill to prepare an ink follower.

Control 3

L-45(5000) (97 parts by weight) and

Aerosil #200 (hydrophilic particulate silica; Nippon Aerosil Co., Ltd.) (3 parts by weight)

were kneaded in a triple roll mill to prepare an ink follower.

Control 4

Nissan Polybutene 015N (NOF Corporation) (96.5 parts by weight),

Aerosil R974 (3 parts by weight) and polyethylene glycol 600 (0.5 parts by weight)

were kneaded in a triple roll mill to prepare an ink follower.

Control 5

TSF451-3000 (96 parts by weight),

Aerosil #380 (hydrophilic particulate silica; Nippon Aerosil Co., Ltd.) (3 parts by weight) and Unilube 75DE-2620 (1 part by weight)

were kneaded in a triple roll mill to prepare an ink follower.

Control 6

KF-50-3000 (96 parts by weight) and

Aerosil R974 (4 parts by weight)

were kneaded in a triple roll mill to prepare an ink follower.

Control 7

TSF4420 (97 parts by weight) and

Aerosil R974 (3 parts by weight)

were kneaded in a planetary mixer to prepare an ink follower.

The above samples were tested and evaluated as follows.

Test 1: Measurement of Viscosity

The ink followers of above embodiments and controls were prepared and their viscosity was measured with a rotary viscometer (E-type viscometer; Tokisangyo Co., Ltd.) at 25° C. and at about 1 $sec^{-1}$.

The ink follower, which is prepared with particulate silica and base oil with a viscosity less than or equal to 5,000 cps, is experientially known not to leak out through the tail end of the ink reservoir immediately after the assembly of the pen when the viscosity of the ink follower at this shear rate is ten times as high as that of the base oil. Accordingly, when the viscosity of the ink follower was more than or equal to the value 10 times as high as that of the base oil, the ink follower is graded as "A." When the viscosity of the ink follower was less than the value 5 times as high as that of the base oil, the ink follower was graded as "C." When the viscosity of the ink follower was more than or equal to the value 5 times as high as that of the base oil and less than the value 10 times as high as that of the base oil, the ink follower was graded as "B," which was an ink follower with a risk of ink leakage due to a change of the form of the ink follower in the ink reservoir from that at the time of the assembly of the pen.

Test 2: Long-term Stability (1)

A part of the rest of the ink follower after the measurement in Test 1 mentioned above was put into a 50-cc screw tube, and left at room temperature for 3 months. After that, its viscosity was measured under the same condition as in Test 1. The data in Test 2 were compared with those respective in Test 1 as initial values.

If the ink follower given thus strong pseudoplasticity undergo the change of its viscosity from −30% to +30% in 3 months, it is experientially known to show the behavior not so different from that in the initial state. Such an ink follower was therefore graded as "A." The ink follower with a decreased viscosity by 50% or more was regarded as unfavorable since, even if the viscosity is 10 times as high as the base oil or more, the viscosity possibly further decreases some time and oil separation is likely to occur. The ink follower with an increased viscosity by 50% or more often inhibits the ink from flowing through the pen tip.

Accordingly, when the difference between the viscosity in Test 2 and that in Test 1 was less than 30%, the ink follower was graded as "A." When the difference was between 30% and 50%, the ink follower was graded as "B." When the difference was 50% or more, the ink follower was graded as "C."

Test 3: Long-term Stability (2) (Storage Test)

Ten ballpoint pens shown in FIG. 1 were assembled for each of the above embodiments and controls. The ink reservoir 10 made of a semi-transparent polypropylene tube with an inner diameter of 4.0 mm was filled with a given ink 20 and an ink follower 30 prepared as each embodiment or control as described above. The pen tip used in a commercially-available ballpoint pen (UM-100, Mitsubishi Pencil Co., Ltd.), which has a similar shape to the pen shown in FIG. 1, was attached to the joint 40. Thus the joint 40 intervenes between the pen tip and the ink reservoir. The pen tip 41 is made of free cutting stainless steel, and the ball 42 with a diameter of 0.5 mm is made of tungsten carbide.

The ballpoint pens assembled as above were laid and left thermostatically at 50° C. for 1 month. After that, each of the pens was checked by seeing if the ink follower had flowed. It was also checked if the ink follower had deformed from the shape at the time of assembly of the pen. The ink follower which had flowed out through the tail end of the ink reservoir was given a score of 0; the ink follower which was observed to deform was given a score of 3; and the ink follower which had hardly changed from its initial state was given a score of 5. Since, each ink follower in the above embodiments and controls was assembled to 10 pens, the best total score is 50 and the worst one is 0.

The results are shown in Table 1.

TABLE 1

| | Test 1 | Test 2 | Test 3 |
|---|---|---|---|
| Embodiment 1 | A | A | 50 |
| Embodiment 2 | A | A | 50 |
| Embodiment 3 | A | A | 50 |
| Embodiment 4 | A | A | 50 |
| Embodiment 5 | A | A | 50 |
| Control 1 | A | C | 50 |
| Control 2 | C | A | 6 |
| Control 3 | A | C | 24 |
| Control 4 | C | A | 9 |
| Control 5 | A | C | 40 |
| Control 6 | C | A | 0 |
| Control 7 | C | A | 0 |

Discussion

Embodiments 1, 2, 3, 4 and 5 showed extremely good results.

Control 1 did not contain the poly (oxyethylene-oxypropylene) polyol which was contained in Embodiment 1, and had an equal initial viscosity to that of Embodiment 1 only with hydrophobic particulate silicate.

Embodiment 1 and Control 1 have an initial viscosity of slightly higher than 50,000 cps at 1 $sec^{-1}$. However, the viscosity of Embodiment 1 increased by less than 10% after 3 months, but that of Control 1 was 270,000 cps that was more than 500% of the initial viscosity. The value is enough to cause a shortage of ink flow due to an increase in the viscosity of the ink follower.

In Control 2, the poly (oxyethylene-oxypropylene) polyol used in Embodiment 1 was replaced by a silane coupling agent. This ink follower showed little viscosity change after 3 months. In the storage test, however, there were many pens of Control 2 in which the ink follower flowed out since the ink follower showed little thickening effect with its initial viscosity of 4000 cps.

In Control 3, striking long-term decrease of the viscosity was observed. This is, as described above, a characteristic phenomenon in the case of using hydrophilic silica.

In Control 4, the ink follower showed a poor performance of storage in the pen since the base oil showed an original viscosity of 5,000 cps. Therefore, though the viscosity of the ink follower at 1 $sec^{-1}$ was as high as 20,000 cps, the ink follower flowed for its weak pseudoplasticity.

The ink follower of Control 5 showed a decreased viscosity characteristic of hydrophilic silica similarly to that of Control 3. Nevertheless, probably because the designed values of initial viscosity of the base oil, the amount of the thickeners and so on, the half of the samples in the storage test was graded as "A" and the other half as "B," which was not so bad. However, the change of the viscosity was so large that it is apprehended that the ink follower will leak out after the storage for a longer period of half a year or a year.

In Control 6, polypropylene glycol used in Embodiment 4 was replaced by the main base oil. The viscosity in Control 6 was 15,000 cps while that in Embodiment 4 higher than 120,000 cps. Control 7 had a similar composition to Embodiment 5, except for ethylene glycol in Embodiment 5, which served as an assistance for thickening the hydrophobic silica.

By the way, in the case that only either polypropylene glycol or ethylene glycol was supplemented to the base oil, except for Embodiments 4 and 5 in which hydrophobic silica was used, thickening effect was not observed at all, and thus the composition could not be used as an ink follower.

Similar results to those of the present Embodiments and Controls were obtained in the tests in which the composition optionally comprised the following constituents:

- either dimethylsilicone oil, methylphenylsilicone oil or alkyl-modified silicone oil as a base oil;
- either Aerosil R-972, R-974, R-976 or RY-200 (Nippon Aerosil Co., Ltd.) as a thickener;
- either ethylene glycol, polyethylene glycol, poly (oxyethylene-oxypropylene) polyol, polypropylene glycol, propylene glycol or the like as $HO(C_2H_4O)_m.(C_3H_6O)_nH$ (in which each of m and n shows 0 or a positive integer, provided that m+n is not equal to 0) and
- either a surfactant such as fluorine surfactants, silicone surfactants, polyoxyethylene derivatives, glycerin-polyglycerin derivatives, sorbitan derivatives, phosphoric esters, etc., a silane coupling agent, an aluminium coupling agent or a titanium coupling agent as an additive.

INDUSTRIAL APPLICABILITY

As described above, the ink follower composition according to the present invention has a high viscosity in a low shear rate range, and little long-term change of the viscosity. Therefore, the ink follower can move to follow the consumption of the ink in the ink reservoir and can keep the water-based ballpoint pen in a good condition for use.

What is claimed is:

1. An ink follower composition used for a water-base ballpoint pen which has an ink reservoir directly filled with ink comprising silicone oil, hydrophobic silica and $HO(C_2H_4O)_m \cdot (C_3H_6O)_nH$ (in which each of m and n shows 0 or a positive integer, provided that m+n is not equal to 0).

2. An ink follower composition as claimed in claim 1, wherein said silicone oil comprises one or more members selected from the group consisting of dimethylsilicone oil, methylphenylsilicone oil and alkyl-modified silicone oil.

3. An ink follower composition as claimed in claim 1, wherein said silicone oil comprises one or more members selected from the group consisting of dimethylsilicone oil, methylphenylsilicone oil and alkyl-modified silicone oil and additional one or more members selected from the group consisting of amino-modified silicone oil, polyether-modified silicone oil and fatty acid-modified silicone oil.

* * * * *